US011739771B2

(12) United States Patent
Paulmann et al.

(10) Patent No.: US 11,739,771 B2
(45) Date of Patent: Aug. 29, 2023

(54) FAILURE DETECTION APPARATUS FOR A HYDRAULIC SYSTEM

(71) Applicants: AIRBUS HELICOPTERS DEUTSCHLAND GMBH, Donauworth (DE); AIRBUS HELICOPTERS, Marignane (FR)

(72) Inventors: Gregor Paulmann, Grasbrunn/Neukeferloh (DE); Genevieve Mkadara, Bourg-les-Valence (FR)

(73) Assignees: AIRBUS HELICOPTERS DEUTSCHLAND GMBH, Donauworth (DE); AIRBUS HELICOPTERS, Marignane (FR)

( * ) Notice: Subject to any disclaimer, the term of this patent is extended or adjusted under 35 U.S.C. 154(b) by 0 days.

(21) Appl. No.: 17/722,470

(22) Filed: Apr. 18, 2022

(65) Prior Publication Data

US 2022/0389943 A1 Dec. 8, 2022

(30) Foreign Application Priority Data

Jun. 2, 2021 (EP) ..... 21400010

(51) Int. Cl.
*F15B 19/00* (2006.01)

(52) U.S. Cl.
CPC ..... *F15B 19/005* (2013.01); *F15B 2211/6306* (2013.01); *F15B 2211/857* (2013.01); *F15B 2211/863* (2013.01)

(58) Field of Classification Search
CPC .... F15B 19/005; F15B 20/004; F15B 20/005; F15B 2211/6306; F15B 2211/857;
(Continued)

(56) References Cited

U.S. PATENT DOCUMENTS 5,563,351 A * 10/1996 Miller ..... F04B 49/10 73/861.42
7,082,758 B2 8/2006 Kageyama et al.
(Continued)

FOREIGN PATENT DOCUMENTS

DE 10334817 A1 3/2005
DE 102008035954 A1 2/2010
(Continued)

OTHER PUBLICATIONS

European Search Report for European Application No. EP 21400010.1, Completed by the European Patent Office, dated Oct. 25, 2021, 5 pages.

*Primary Examiner* — Kenneth Bomberg
*Assistant Examiner* — Matthew Wiblin
(74) *Attorney, Agent, or Firm* — Brooks Kushman P.C.

(57) ABSTRACT

A failure detection apparatus for a hydraulic system, to a hydraulic, failure detection-capable system, and to a method of operating a failure detection apparatus. The failure detection apparatus comprises a monitoring and failure detection unit that receives first and second pressure values from first and second pressure sensors and comprises a failure detection unit that detects a failure of at least one hydraulically operated device when a 2-tuple of a plurality of 2-tuples is within a first and outside a second predetermined tolerance range of relative pressure values, and wherein the failure detection unit 260 detects a failure of the pump when a 2-tuple of the plurality of 2-tuples is outside the first predetermined tolerance range of relative pressure values.

13 Claims, 4 Drawing Sheets

(58) Field of Classification Search
CPC ..... F15B 2211/863; F15B 2211/8633; F15B 2211/864
See application file for complete search history.

(56) References Cited

U.S. PATENT DOCUMENTS

| | | | | |
|---|---|---|---|---|
| 8,437,922 | B2 | 5/2013 | Douglas | |
| 2005/0262838 | A1 | 12/2005 | Kageyama et al. | |
| 2011/0056192 | A1* | 3/2011 | Weber | E02F 9/2292 60/428 |
| 2017/0184138 | A1 | 6/2017 | Smith et al. | |
| 2021/0088058 | A1 | 3/2021 | Tomioka | |

FOREIGN PATENT DOCUMENTS

| | | | |
|---|---|---|---|
| EP | 1674365 | A1 | 6/2006 |
| EP | 1988287 | B1 | 11/2008 |
| FR | 3087887 | B1 | 5/2020 |
| JP | 4542819 | B2 | 12/2005 |
| WO | 2013063262 | A1 | 5/2013 |

* cited by examiner

FAILURE DETECTION APPARATUS FOR A HYDRAULIC SYSTEM

CROSS-REFERENCE TO RELATED APPLICATIONS

This application claims priority to European patent application No. EP 21400010.1 filed on Jun. 2, 2021, the disclosure of which is incorporated in its entirety by reference herein.

TECHNICAL FIELD

The present embodiments relate to a failure detection apparatus, and, more particularly, to a failure detection apparatus for a hydraulic system. The present embodiments further relate to a hydraulic, failure detection-capable system with such a failure detection apparatus, and to a method of operating such a failure detection apparatus for detecting failures in a hydraulic system.

BACKGROUND

In many technical applications which are using hydraulic power as its primary or redundant source of power, it is of the utmost importance that the required hydraulic power is provided with the maximum possible level of reliability for safety and economic reasons.

Therefore, the health condition of hydraulic systems is often observed by monitoring different parameters including pressures, leakages, temperature, vibration, etc. A change in one or more of such parameters is usually indicative of a developing fault in the associated hydraulic system.

Conventionally, known failure detection apparatuses for hydraulic systems define health identifiers from the monitored parameters. Such health identifiers are usually composed of calculated and/or simulated parameters in addition to measured and processed parameters.

During the operation of the hydraulic systems, conventional failure detection apparatuses usually observe such health identifiers using a dedicated monitoring algorithm for the purpose of detecting a fault development in the hydraulic system. In some applications, the monitoring algorithm is implemented as software into the hydraulic system to allow for online, real-time fault monitoring. Alternatively, the monitoring algorithm is implemented as remote software for offline post-operation analysis.

Common methods of monitoring hydraulic systems for the purpose of fault detection include, for example, US 2017/0184138 A1, DE 10 2008 035 954 A1, EP 1 674 365 A1, DE 103 34 817 A1, EP 1 988 287 B1, FR 3 087 887 B1, JP 4 542 819 B2, U.S. Pat. Nos. 5,563,351 A, 8,437,922 B2, US2021088058 and WO 2013/063262 A1.

However, the above-described methods of monitoring hydraulic systems all use dependencies between parameters of different types for the definition of an identifier for the hydraulic system health. They also often rely on overly complicated measuring apparatuses.

Document U.S. Pat. No. 7,082,758 B2 describes a hydraulic machine in which hydraulic pump failure is detected and the pump lifespan is estimated before the pump failure occurs. The discharge pressure, oil temperature, and drain filter differential pressure are measured, a correlative relationship between the filter differential pressure and the discharge pressure is determined, and a representative filter differential pressure is calculated from this correlative relationship. Using an oil temperature-differential pressure correlation function, the representative differential pressure value is corrected so that the variable component caused by the oil temperature is eliminated therefrom. The long-term trend and the short-term trend of the increase over time of the corrected differential pressure is calculated. A pump failure is predicted or the pump lifespan is estimated based on the degree of deviation between the long-term trend and the short-term trend.

However, the described method requires the presence of a filter to measure the drain filter differential pressure. Moreover, the definition of the identifier for the hydraulic pump health is determined by a linear correlation from the online measured data (i.e., during the operation of the hydraulic system). The correlation is then used to define a representative differential pressure. The representative differential pressure is then monitored over time and compared to a predetermined differential pressure. In other words, the differential pressure is the health indicator. Furthermore, the described method only detects faults of the hydraulic pump, but fails to detect faults of the associated hydraulic system. Moreover, the described method requires a temperature sensor to determine the oil temperature.

SUMMARY

It is, therefore, a first objective to provide a new failure detection apparatus for a hydraulic system. The new failure detection apparatus should be able to detect both, faults of the hydraulic pump and faults of the associated hydraulic system. Moreover, the new failure detection apparatus should be able to differentiate between a failure of the hydraulic pump and a failure of the associated hydraulic system. Furthermore, a second objective is to provide a new hydraulic, failure detection-capable system comprising such a new failure detection apparatus, and a third objective is to provide a method of operating such a new failure detection apparatus.

The first objective is solved by a failure detection apparatus for a hydraulic system, said failure detection apparatus comprising the features of claim 1.

More specifically, a failure detection apparatus for a hydraulic system, the hydraulic system comprising a tank with hydraulic fluid, a plurality of hydraulically operated devices, a supply line, a pump that delivers the hydraulic fluid from the tank via the supply line to the plurality of hydraulically operated devices, and a case drain line for returning hydraulic fluid from the pump to the tank, comprises a first pressure sensor that senses a first pressure value of the hydraulic fluid in the supply line; a second pressure sensor that senses a second pressure value of the hydraulic fluid in the case drain line; and a monitoring and failure detection unit that receives the first and second pressure values from the first and second pressure sensors and comprises a monitoring unit that monitors first and second pressure values from the first and second pressure sensors during operation of the plurality of hydraulically operated devices, and a failure detection unit that memorizes a plurality of 2-tuples of first and second pressure values, wherein the failure detection unit detects a failure of at least one hydraulically operated device of the plurality of hydraulically operated devices when a 2-tuple of the plurality of 2-tuples is within a first predetermined tolerance range of relative pressure values and outside a second predetermined tolerance range of relative pressure values, and wherein the failure detection unit detects a failure of the pump when the 2-tuple of the plurality of 2-tuples is outside the first predetermined tolerance range of relative pressure values.

As an example, a hydraulic system may include a variable displacement pump that is driven by an external mechanical source. The hydraulic pump may deliver hydraulic fluid from a tank to a plurality of hydraulically operated devices (e.g., valves, actuators, and other consumers of the hydraulic fluid) via a supply line and from there back to the tank via a drain line. A first pressure sensor may be installed in the supply line (e.g., between a filter and the plurality of hydraulically operated devices).

The hydraulic pump may return hydraulic fluid to the tank via a case drain line. A second pressure sensor may be installed in the case drain line.

A first software program may run on a computer which combines through a first algorithm the signals of the first and second pressure sensors into a defined proportion during a unique initial calibration before starting the hydraulic system in normal operation mode.

A second software program may calculate and memorize through a second algorithm a reference curve based on the supply and the case drain pressures out of such a unique initial calibration. This reference curve includes a safe zone, also referred as tolerances, that covers statistical scatter of measurements within an acceptable magnitude, and additional thresholds for accurate detection of degradations of the hydraulic system. Such a safe zone and such thresholds are defined for predetermined parameters.

A third software program may calculate and memorize through a third algorithm the obtained pressure signals during specific operational states in normal operation mode of the hydraulic system into pressure proportions with a time stamp.

A fourth software program that is based on a fourth algorithm may compare the obtained pressure signals with the determined thresholds and indicate a deviation from the determined thresholds. If desired, the fourth software program may monitor trends of the obtained pressure signals versus the reference curve.

A fifth software program that is based on a fifth algorithm may determine whether any deviations of the obtained pressure proportions during normal system operation originate from a fault of the hydraulic pump or a fault of the remaining hydraulic system components, for example by monitoring if a measurement point for a certain measurement condition exceeds thresholds of predetermined tolerances around the reference curve.

A sixth software program that is based on a sixth algorithm may memorize the outputs of the fourth and fifth software program and optionally inform an operator.

If desired, a temperature sensor may be connected to the tank to improve the robustness of monitoring against temperature variation.

Thus, the number of pressure sensors is reduced to a minimum of two. In fact, only one additional pressure sensor in the case drain line will be needed in addition to the pressure sensor in the supply line. The presence of pressure and temperature sensors in the pressure supply line is considered as given for the majority of hydraulic systems.

The software programs feature several specific but non-complex algorithms to process the pressure signals and to enable the detection of fault developments in the hydraulic pump or the remaining hydraulic system components based on the idea of a damage indication curve (DIC), which is sometimes also referred to as a faultless operation curve.

Furthermore, the software programs allow for a robust and reliable design of a health condition monitoring system that meets safe operation and economic constraints. Moreover, due to its simple structure and robustness, the fault detection apparatus may be used in real-time and in post-processing applications for mobile and stationary hydraulic systems.

According to one aspect, the failure detection unit determines a trend based on the plurality of 2-tuples, and wherein the failure detection unit detects at least one of the failure of at least one hydraulically operated device of the plurality of hydraulically operated devices or the failure of the pump based on the trend.

According to one aspect, the failure detection apparatus further comprises a temperature sensor that senses a current temperature value of the hydraulic fluid in the tank and provides the current temperature value to the monitoring and failure detection unit, and wherein the failure detection unit adjusts the first predetermined tolerance range of relative pressure values and the second predetermined tolerance range of relative pressure values based on the current temperature value of the hydraulic fluid.

According to one aspect, the monitoring and failure detection unit further comprises a calibration unit that determines the first predetermined tolerance range of relative pressure values and the second predetermined tolerance range of relative pressure values based on the first and second pressure values received from the first and second pressure sensors during an initial calibration of the hydraulic system before the operation of the plurality of hydraulically operated devices.

According to one aspect, the calibration unit determines the first and the second predetermined tolerance ranges of relative pressure values based on predetermined operation conditions of the pump.

According to one aspect, the monitoring and failure detection unit further comprises an output device that outputs at least one of the monitored first and second pressure values of the hydraulic fluid, the detected failure of at least one hydraulically operated device of the plurality of hydraulically operated devices, or the detected failure of the pump.

Furthermore, the second objective is solved by a hydraulic, failure detection-capable system, said hydraulic, failure detection-capable system comprising the features of claim 7.

More specifically, a hydraulic, failure detection-capable system comprises the failure detection apparatus described above, and a hydraulic system comprising a tank with hydraulic fluid, a plurality of hydraulically operated devices, a supply line, a pump that delivers the hydraulic fluid from the tank via the supply line to the plurality of hydraulically operated devices, a return line for returning the hydraulic fluid from the plurality of hydraulically operated devices to the tank, and a case drain line for returning hydraulic fluid from the pump to the tank.

According to one aspect, the hydraulic system further comprises a filter in the supply line between the pump and the plurality of hydraulically operated devices.

According to one aspect, the hydraulic system further comprises a drive mechanism that drives the pump.

Moreover, the third objective is solved by a method of operating the fault detection apparatus described above comprising the features of claim 10.

More specifically, a method of operating the failure detection apparatus described above comprises the operations of: with the first pressure sensor, sensing a first pressure value of the hydraulic fluid in the supply line; with the second pressure sensor, sensing a second pressure value of the hydraulic fluid in the case drain line; with the monitoring and failure detection unit, receiving the first and second pressure values from the first and second pressure sensors; with the monitoring unit of the monitoring and failure detection unit, monitoring first and second pressure values from the first and second pressure sensors when the hydraulic system is in a normal operation mode; with the failure detection unit of the monitoring and failure detection unit, memorizing a plurality of 2-tuples of first and second pressure values in the normal operation mode; with the failure detection unit of the monitoring and failure detection unit, detecting a failure of at least one hydraulically operated device of the plurality of hydraulically operated devices when a 2-tuple of the plurality of 2-tuples is within a first predetermined tolerance range of relative pressure values and outside a second predetermined tolerance range of relative pressure values; and with the failure detection unit, detecting a failure of the pump when the 2-tuple of the plurality of 2-tuples is outside the first predetermined tolerance range of relative pressure values.

According to one aspect, the method further comprises with the monitoring and failure detection unit, generating a faultless operation curve based on an extrapolation of the first and second pressure values that are received by the monitoring and failure detection unit when the hydraulic system is in a calibration mode.

According to one aspect, the method further comprises with the monitoring and failure detection unit, determining the first predetermined tolerance range of relative pressure values and the second predetermined tolerance range of relative pressure values based on the faultless operation curve.

According to one aspect, the method further comprises with the monitoring and failure detection unit, determining a trend based on the plurality of 2-tuples; and detecting at least one of the failure of at least one hydraulically operated device of the plurality of hydraulically operated devices or the failure of the pump based on the trend.

According to one aspect, the method further comprises generating and providing statistics about the first and second pressure values of the hydraulic fluid based on the plurality of 2-tuples at the different time stamps.

According to one aspect, the method further comprises in response to detecting a failure of the at least one hydraulically operated device of the plurality of hydraulically operated devices or in response to detecting a failure of the pump, notifying an operator of the hydraulic system about the detected failure.

BRIEF DESCRIPTION OF THE DRAWINGS

Preferred embodiments are outlined by way of example in the following description with reference to the attached drawings. In these attached drawings, identical or identically functioning components and elements are labeled with identical reference numbers and characters and are, consequently, only described once in the following description.

DETAILED DESCRIPTION

Exemplary embodiments of a failure detection apparatus may be used with any hydraulic system. Examples of equipment with a hydraulic system may include excavators, bulldozers, backhoes, log splitters, shovels, loaders, forklifts, and cranes, hydraulic brakes, power steering systems, automatic transmissions, garbage trucks, aircraft flight control systems, lifts, industrial machinery, etc.

Figure 1:
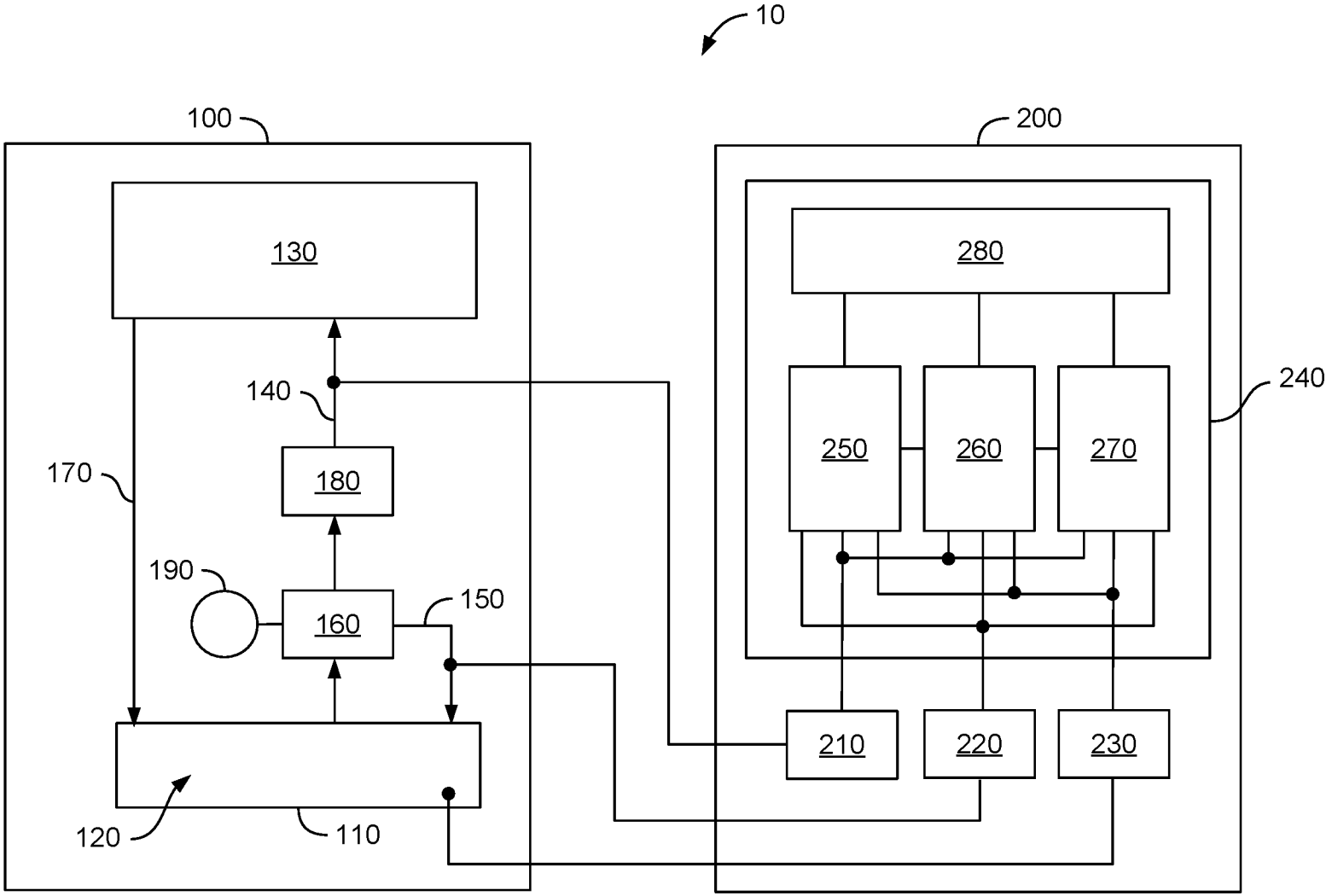
FIG. 1 is a diagram of an illustrative hydraulic, failure detection-capable system that includes a hydraulic system and a failure detection apparatus in accordance with some embodiments.

FIG. 1 is a diagram of a hydraulic, failure detection-capable system 10 that includes a hydraulic system 100 and a failure detection apparatus 200 that is coupled to the hydraulic system 100.

Illustratively, the hydraulic system 100 may include a tank 110. The tank 110 may be open and operate under atmospheric pressure. Alternatively, the tank 110 may be closed and pressurized.

The tank 110 may be filled with hydraulic fluid 120. The hydraulic fluid 120 may be any fluid that is suitable to be used in a hydraulic system. For example, the hydraulic fluid may be based on mineral oil and/or on water.

By way of example, the hydraulic system may include a plurality of hydraulically operated devices 130. The hydraulically operated devices 130 may include hydraulic motors, hydraulic cylinders or other hydraulic actuators, control valves, tubes, hoses, and/or other consumers of hydraulic fluid, just to name a few.

The hydraulic system 100 may include a supply line 140, and a pump 160 that delivers the hydraulic fluid 120 from the tank 110 via the supply line 140 to the plurality of hydraulically operated devices 130. If desired, the pump 160 may be implemented as a piston pump of the variable displacement type. The pump 160 may supply the hydraulic fluid 120 at given rates to the hydraulically operated devices 130.

Illustratively, the hydraulic system 100 may include a drive mechanism 190. The drive mechanism 190 may drive the pump 160. If desired, the drive mechanism 190 may include an external mechanical actuator and/or an electric motor.

Illustratively, the hydraulic system 100 may include a return line 170 for returning the hydraulic fluid 120 from the plurality of hydraulically operated devices 130 to the tank 110, and a case drain line 150 for returning hydraulic fluid 120 from the pump 160 to the tank 110.

If desired, the hydraulic system 100 may include a filter 180. The filter 180 may be used to remove impurities from the hydraulic fluid 120. Illustratively, the filter 180 may be a high-pressure filter that is located in the supply line 140. As an example, the filter 180 may be located in the supply line 140 between the pump 160 and the plurality of hydraulically operated devices 130.

Illustratively, the failure detection apparatus 200 may include first and second pressure sensor 210, 220. The first pressure sensor 210 may sense a first pressure value of the hydraulic fluid 120 in the supply line 140, and the second pressure sensor 220 may sense a second pressure value of the hydraulic fluid 120 in the case drain line 150.

If desired, the failure detection apparatus 200 may include a temperature sensor 230. The temperature sensor 230 may sense a current temperature value of the hydraulic fluid 120 in the tank 110.

By way of example, the failure detection apparatus 200 may include a monitoring and failure detection unit 240. The monitoring and failure detection unit 240 may receive the first and second pressure values from the first and second pressure sensors 210, 220.

Illustratively, the monitoring and failure detection unit 240 may include a monitoring unit 250 and a failure detection unit 260. The monitoring unit 250 may monitor first and second pressure values from the first and second pressure sensors 210, 220 during operation of the plurality of hydraulically operated devices 130.

By way of example, the failure detection unit 260 may memorize a plurality of 2-tuples of first and second pressure values. The failure detection unit 260 may detect a failure of at least one hydraulically operated device of the plurality of hydraulically operated devices 130 when a 2-tuple of the plurality of 2-tuples is within a first predetermined tolerance range of relative pressure values and outside a second predetermined tolerance range of relative pressure values. The failure detection unit 260 may detect a failure of the pump 160 when the 2-tuple of the plurality of 2-tuples is outside the first predetermined tolerance range of relative pressure values.

Illustratively, the failure detection unit 260 may adjust the first predetermined tolerance range of relative pressure values and the second predetermined tolerance range of relative pressure values based on the current temperature value of the hydraulic fluid 120 measured by the temperature sensor 230.

If desired, the monitoring and failure detection unit 240 may include an output device 280. The output device 280 may output at least one of the monitored first and second pressure values of the hydraulic fluid 120, the detected failure of at least one hydraulically operated device of the plurality of hydraulically operated devices 130, or the detected failure of the pump 160.

As shown in FIG. 1, the monitoring and failure detection unit 240 may include a calibration unit 270. The calibration unit 270 may determine the first predetermined tolerance range of relative pressure values and the second predetermined tolerance range of relative pressure values based on the first and second pressure values received from the first and second pressure sensors 210, 220 during an initial calibration of the hydraulic system 100 before the operation of the plurality of hydraulically operated devices 130.

Illustratively, the calibration unit 270 may determine the first and the second predetermined tolerance ranges of relative pressure values based on predetermined operation conditions of the pump 160.

Figure 2:
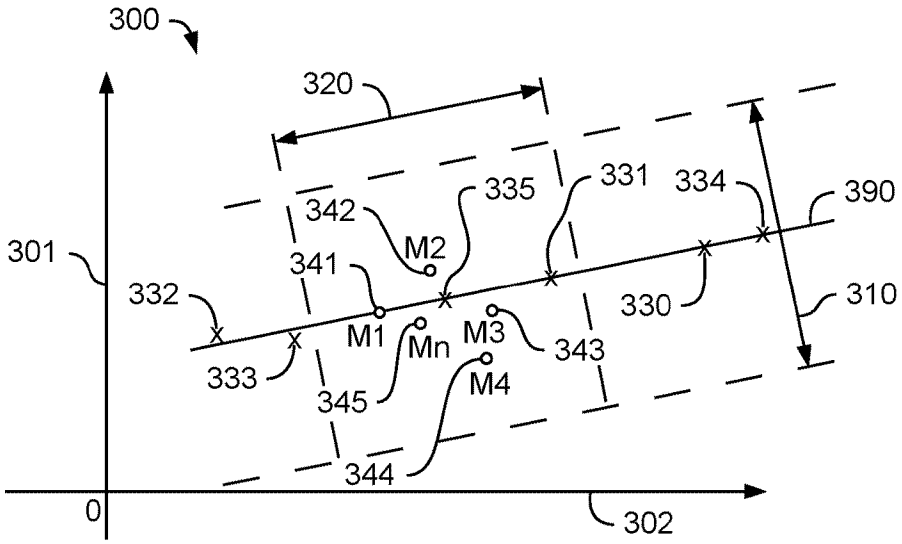
FIG. 2 is a diagram of an illustrative faultless operation curve and associated predetermined tolerance ranges of relative pressure values of a hydraulic system in accordance with some embodiments.

FIG. 2 is a diagram of an illustrative faultless operation curve 390 and associated predetermined tolerance ranges of relative pressure values 310, 320 of a hydraulic system (e.g., hydraulic system 100 of FIG. 1). The faultless operation curve 390 may be determined using a calibration unit (e.g., calibration unit 270 of FIG. 1) during an initial calibration of the hydraulic system.

Illustratively, during an initial calibration of the hydraulic system, a calibration unit such as calibration unit 270 of FIG. 1 may receive first and second pressure values of the hydraulic fluid in supply and case drain lines from first and second sensors, respectively. The first and second sensors may provide the first and second pressure values during the initial calibration for predetermined working conditions of the plurality of hydraulically operated devices and/or predetermined operation conditions of the pump.

The calibration unit may define calibration points 330, 331, 332, 333, 334, 335 based on the first and second pressure values. The number of calibration points may depend on the number of predetermined working conditions of the plurality of hydraulically operated devices and/or on the number of predetermined operation conditions of the pump. Thus, there may be any number of calibration points. For simplicity and clarity, the number of calibration points in FIG. 2 have been limited to six. However, any number greater than one may be used, if desired.

The calibration points 330, 331, 332, 333, 334, 335 may be represented in a two-dimensional Cartesian coordinate system 300 with case pressure 301 (i.e., the second pressure value of the hydraulic fluid 120 measured by the second pressure sensor 220 in the case drain line 150 of FIG. 1) as ordinate and supply pressure 302 (i.e., the first pressure value of the hydraulic fluid 120 measured by the first pressure sensor 210 in the supply line 140 of FIG. 1) as abscissa. Thus, the calibration points 330 to 335 are represented as 2-tuples of supply and case pressure.

Illustratively, the calibration unit may determine a faultless operation curve 390 based on the calibration points 330 to 335. For example, the calibration unit may perform a regression analysis of the calibration points 330 to 335 to determine the faultless operation curve 390.

As an example, the calibration unit may perform a linear regression to determine the faultless operation curve 390 as having a linear dependency between the case pressure 301 and the supply pressure 302. As another example, the calibration unit may perform a non-linear regression to determine the faultless operation curve 390 as having a non-linear dependency between the case pressure 301 and the supply pressure 302.

By way of example, the calibration unit may determine a first predetermined tolerance range of relative pressure values 310 and a second predetermined tolerance range of relative pressure values 320 based on the first and second pressure values received from the first and second pressure sensors during the initial calibration of the hydraulic system before the operation of the plurality of hydraulically operated devices.

For example, the calibration unit may determine the first and the second predetermined tolerance ranges of relative pressure values 310, 320 based on predetermined operation conditions of the pump and/or based on predetermined working conditions of the plurality of hydraulically operation devices.

As an example, the calibration unit may determine the first predetermined tolerance range of relative pressure values 310 as an absolute or relative distance from the faultless operation curve 390. As another example, the calibration unit may determine the second predetermined tolerance range of relative pressure values 320 based on minimum and maximum values on the faultless operation curve 390 that contain all calibration points.

If desired, the first and second predetermined tolerance ranges of relative pressure values 310, 320 may form a tube around the faultless operation curve 390 in the two-dimensional Cartesian coordinate system 300 with ordinate case pressure 301 and abscissa supply pressure 302. In the scenario in which the calibration unit defines the faultless operation curve 390 as a straight line (e.g., through a linear regression), the first and second predetermined tolerance ranges of relative pressure values 310, 320 may form a rectangle in the two-dimensional Cartesian coordinate system 300.

During normal operation of the plurality of hydraulically operated devices, a monitoring and failure detection unit (e.g., monitoring and failure detection unit 240 of FIG. 1) may receive first and second pressure values from first and second pressure sensors. For example, the monitoring and failure detection unit may receive first and second pressure values from first and second pressure sensors at different time stamps.

As an example, the monitoring and failure detection unit may receive a first 2-tuple of first and second pressure values 341 at a first time stamp, a second 2-tuple of first and second pressure values 342 at a second time stamp, a third 2-tuple of first and second pressure values 343 at a third time stamp, a fourth 2-tuple of first and second pressure values 344 at a fourth time stamp, a fifth 2-tuple of first and second pressure values 345 at a fifth time stamp, etc.

The monitoring and failure detection unit may include a monitoring unit (e.g., monitoring unit 250 of FIG. 1) that monitors the first and second pressure values, and a failure detection unit (e.g., failure detection unit 260 of FIG. 1) that memorizes the plurality of 2-tuples of first and second pressure values 341, 342, 343, 344, 345.

The failure detection unit may detect a failure of at least one hydraulically operated device of the plurality of hydraulically operated devices when a 2-tuple of the plurality of 2-tuples 341, 342, 343, 344, 345 is within a first predetermined tolerance range of relative pressure values 310 and outside a second predetermined tolerance range of relative pressure values 320. The failure detection unit may detect a failure of the pump when the 2-tuple of the plurality of 2-tuples 341, 342, 343, 344, 345 is outside the first predetermined tolerance range of relative pressure values 310.

As shown in FIG. 2, all 2-tuples of first and second pressure values 341 to 345 that are recorded during normal operation of the hydraulic system are located within the first predetermined tolerance range of relative pressure values 310. Thus, no failure was detected for the pump of the hydraulic system.

As also shown in FIG. 2, all 2-tuples of first and second pressure values 341 to 345 that are recorded during normal operation of the hydraulic system are located within the second predetermined tolerance range of relative pressure values 320. Thus, no failure was detected for the hydraulically operated devices of the plurality of hydraulically operated devices of the hydraulic system.

Illustratively, the failure detection apparatus (e.g., failure detection apparatus 200 of FIG. 1) may determine a failure of one of the hydraulically operated devices of the plurality of hydraulically operated device and/or a failure of the pump based on determining a trend of the plurality of 2-tuples 341, 342, 343, 344, 345 over time.

Figure 3A:
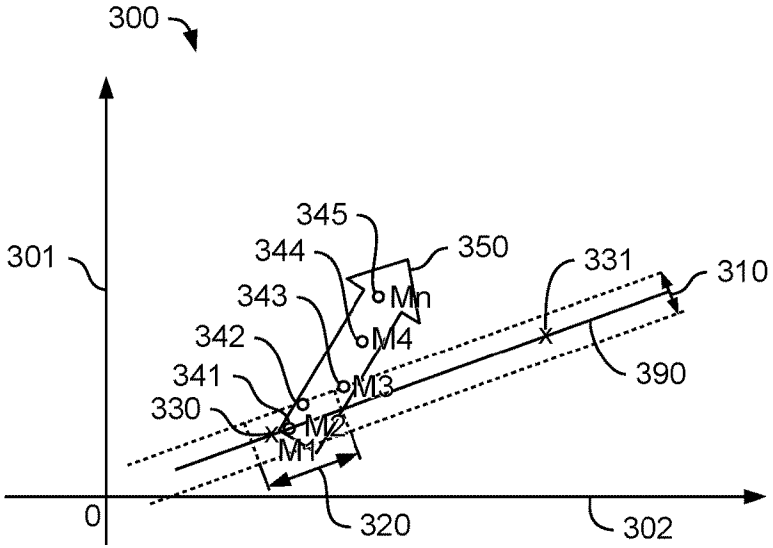
FIG. 3A is a diagram of an illustrative trend monitoring that is indicative of a pump failure in accordance with some embodiments.

FIG. 3A is a diagram of an illustrative trend monitoring 350 that is indicative of a pump failure. As shown in FIG. 3A, a failure detection unit (e.g., failure detection unit 260 of FIG. 1) memorizes 2-tuples of first and second pressure values 341 to 345 (e.g., 2-tuples of supply and case pressure) that are recorded during normal operation of the hydraulic system at different time stamps.

As an example, consider the scenario in which the 2-tuples of first and second pressure values are recorded during successive time stamps. In this scenario, the first two recorded 2-tuples of first and second pressure values 341 and 342 are located within the first and second predetermined tolerance ranges of relative pressure values 310, 320.

However, successively recorded 2-tuples of first and second pressure values 343, 344, 345 lie outside the first and second predetermined tolerance ranges of relative pressure values 310, 320. In fact, the failure detection unit may determine a trend 350 based on the plurality of 2-tuples 341 to 345.

The trend 350 shows that successive 2-tuples of first and second pressure values 341 to 345 point mainly in a direction away from the faultless operation curve 390. As shown in FIG. 3A, the case pressure values increase over proportionately compared to the supply pressure values. The trend 350 may be indicative of a pump failure, and thus, the failure detection unit may detect a failure of the pump based on the trend 350.

Figure 3B:
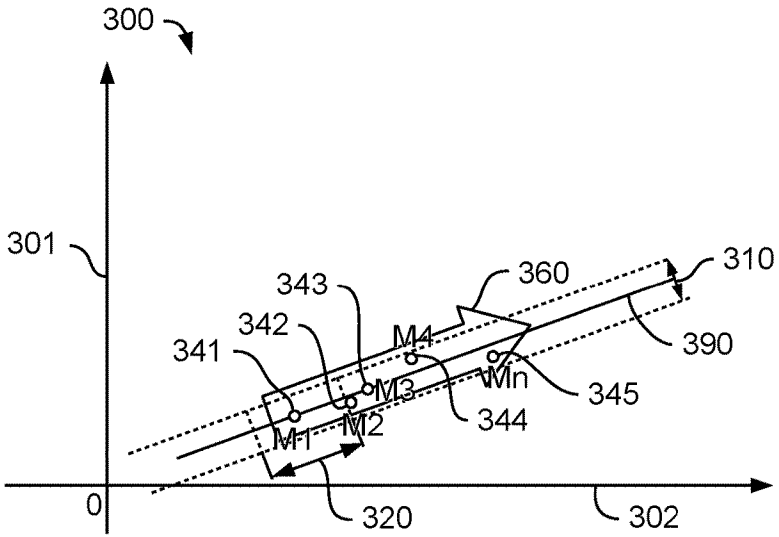
FIG. 3B is a diagram of an illustrative trend monitoring that is indicative of a hydraulically operated device failure in accordance with some embodiments.

FIG. 3B is a diagram of an illustrative trend monitoring 360 that is indicative of a hydraulically operated device failure. As shown in FIG. 3B, a failure detection unit (e.g., failure detection unit 260 of FIG. 1) memorizes 2-tuples of first and second pressure values 341 to 345 (e.g., 2-tuples of supply and case pressure) that are recorded during normal operation of the hydraulic system at different time stamps.

As an example, consider the scenario in which the 2-tuples of first and second pressure values are recorded during successive time stamps. In this scenario, the first two recorded 2-tuples of first and second pressure values 341 and 342 are located within the first and second predetermined tolerance ranges of relative pressure values 310, 320.

However, successively recorded 2-tuples of first and second pressure values 343, 344, 345 lie inside the first predetermined tolerance range of relative pressure values 310 and outside the second predetermined tolerance range of relative pressure values 320. In fact, the failure detection unit may determine a trend 360 based on the plurality of 2-tuples 341 to 345.

The trend 360 shows that successive 2-tuples of first and second pressure values 341 to 345 point mainly in a direction that is parallel to the faultless operation curve 390. As shown in FIG. 3B, the case pressure values increase compared to the supply pressure values in the same proportions as the 2-tuples of the faultless operation curve 390. The trend 360 may be indicative of a hydraulically operated device failure, and thus, the failure detection unit may detect a failure of at least one of the plurality of hydraulically operated devices of the hydraulic system based on the trend 360.

Figure 3C:
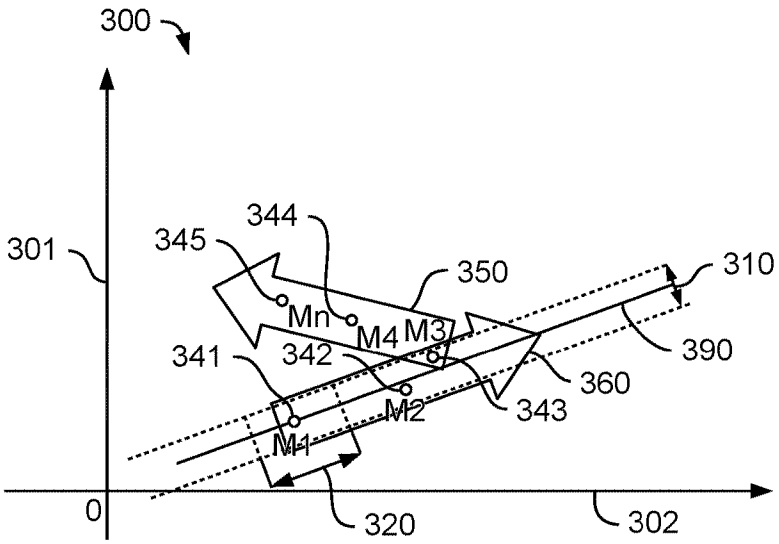
FIG. 3C is a diagram of an illustrative trend monitoring that is indicative of a hydraulically operated device failure that is followed by a pump failure in accordance with some embodiments.

FIG. 3C is a diagram of an illustrative trend monitoring that is indicative of a hydraulically operated device failure that is followed by a pump failure. Illustratively, a failure detection unit (e.g., failure detection unit 260 of FIG. 1) memorizes 2-tuples of first and second pressure values 341 to 345 (e.g., 2-tuples of supply and case pressure) that are recorded during normal operation of the hydraulic system at successive time stamps.

As shown in FIG. 3C, the first recorded 2-tuple of first and second pressure values 341 is located within the first and second predetermined tolerance ranges of relative pressure values 310, 320. At that time, no pump failure and no failure of at least one hydraulically operated device is detected.

However, successively recorded 2-tuples of first and second pressure values 342, 343, 344, 345 lie outside the first and/or the second predetermined tolerance range of relative pressure values 310, 320. In fact, the failure detection unit may determine a first trend 360 based on the plurality of 2-tuples 341 to 343.

This first trend 360 shows that successive 2-tuples of first and second pressure values 341 to 343 point mainly in a direction that is parallel to the faultless operation curve 390.

As shown in FIG. 3C, the case pressure values increase compared to the supply pressure values in the same proportions as the 2-tuples of the faultless operation curve 390. The first trend 360 may be indicative of a hydraulically operated device failure, and thus, the failure detection unit may detect a failure of at least one of the plurality of hydraulically operated devices of the hydraulic system based on the first trend 360.

Subsequently, the failure detection unit may determine a second trend 350 based on the 2-tuples 343 to 345.

This second trend 350 shows that successive 2-tuples of first and second pressure values 343 to 345 point mainly in a direction away from the faultless operation curve 390. As shown in FIG. 3C, the case pressure values increase while the supply pressure values decrease. The trend 350 may be indicative of a pump failure, and thus, the failure detection unit may detect a failure of the pump based on the trend 350.

Figure 4:
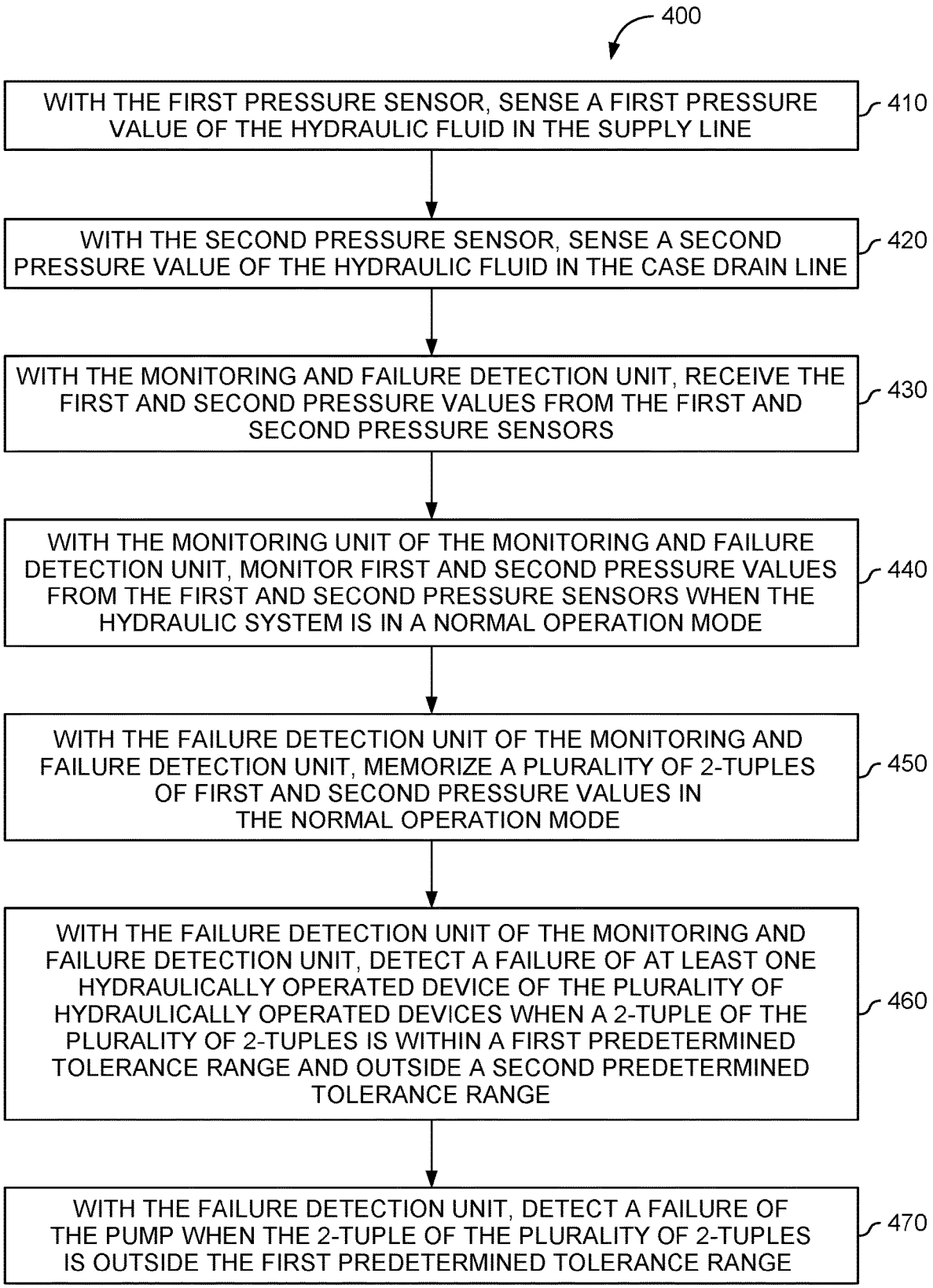
FIG. 4 is a flowchart showing illustrative operations for operating a fault detection apparatus of a hydraulic system in accordance with some embodiments.

FIG. 4 is a flowchart 400 showing illustrative operations for operating a failure detection apparatus such as the failure detection apparatus 200 of FIG. 1.

During operation 410, the failure detection apparatus may, with a first pressure sensor, sense a first pressure value of the hydraulic fluid in the supply line.

For example, the first pressure sensor 210 of the failure detection apparatus 200 of FIG. 1 may sense a first pressure value of the hydraulic fluid 120 in the supply line 140.

During operation 420, the failure detection apparatus may, with the second pressure sensor, sense a second pressure value of the hydraulic fluid in the case drain line.

For example, the second pressure sensor 220 of the failure detection apparatus 200 of FIG. 1 may sense a second pressure value of the hydraulic fluid 120 in the case drain line 150.

During operation 430, the failure detection apparatus may, with the monitoring and failure detection unit, receive the first and second pressure values from the first and second pressure sensors.

For example, the monitoring and failure detection unit 240 of the failure detection apparatus 200 of FIG. 1 may receive the first and second pressure values from the first and second pressure sensors 210, 220.

During operation 440, the failure detection apparatus may, with the monitoring unit of the monitoring and failure detection unit, monitor first and second pressure values from the first and second pressure sensors when the hydraulic system is in a normal operation mode.

For example, the monitoring unit 250 of the monitoring and failure detection unit 240 of the failure detection apparatus 200 of FIG. 1 may monitor first and second pressure values from the first and second pressure sensors 210, 220 when the hydraulic system 100 is in a normal operation mode.

During operation 450, the failure detection apparatus may, with the failure detection unit of the monitoring and failure detection unit, memorize a plurality of 2-tuples of first and second pressure values in the normal operation mode.

For example, the failure detection unit 260 of the monitoring and failure detection unit 240 of the failure detection apparatus 200 of FIG. 1 may memorize a plurality of 2-tuples of first and second pressure values (e.g., 2-tuples 341, 342, 343, 344, 345 of FIGS. 2 to 3C) in the normal operation mode.

During operation 460, the failure detection apparatus may, with the failure detection unit of the monitoring and failure detection unit, detect a failure of at least one hydraulically operated device of the plurality of hydraulically operated devices when a 2-tuple of the plurality of 2-tuples is within a first predetermined tolerance range of relative pressure values and outside a second predetermined tolerance range of relative pressure values.

For example, the failure detection unit 260 of the monitoring and failure detection unit 240 of the failure detection apparatus 200 of FIG. 1 may detect a failure of at least one hydraulically operated device of the plurality of hydraulically operated devices 130 when a 2-tuple of the plurality of 2-tuples 341, 342, 343, 344, 345 of FIGS. 2 to 3C is within a first predetermined tolerance range of relative pressure values 310 and outside a second predetermined tolerance range of relative pressure values 320.

During operation 470, the failure detection apparatus may, with the failure detection unit, detect a failure of the pump when the 2-tuple of the plurality of 2-tuples is outside the first predetermined tolerance range of relative pressure values.

For example, the failure detection unit 260 of the failure detection apparatus 200 of FIG. 1 may detect a failure of the pump 160 when the 2-tuple of the plurality of 2-tuples 341, 342, 343, 344, 345 of FIGS. 2 to 3C is outside the first predetermined tolerance range of relative pressure values 310.

The hydraulic system may operate in the normal operation mode after having performed a successful calibration in a calibration mode. In preparation for the calibration, all components of the hydraulic system are verified as to whether the components have any defects.

Then, in response to verifying that the components of the hydraulic system have no defects, the failure detection apparatus may, with the monitoring unit of the monitoring and failure detection unit, monitor first and second pressure values from the first and second pressure sensors and, with the failure detection unit of the monitoring and failure detection unit, memorize a plurality of 2-tuples of first and second pressure values.

For example, the monitoring unit 250 of the monitoring and failure detection unit 240 of the failure detection apparatus 200 of FIG. 1 may monitor first and second pressure values from the first and second pressure sensors 210, 220, and the failure detection unit 260 of the monitoring and failure detection unit 240 of the failure detection apparatus 200 of FIG. 1 may memorize a plurality of 2-tuples of first and second pressure values (e.g., 2-tuples 341, 342, 343, 344, 345 of FIGS. 2 to 3C).

Illustratively, the failure detection apparatus may, with the monitoring and failure detection unit, generate a faultless operation curve (e.g., faultless operation curve 390 of FIGS. 2 to 3C) based on an extrapolation of the first and second pressure values that are received by the monitoring and failure detection unit when the hydraulic system is in the calibration mode (i.e., based on the memorized plurality of 2-tuples of first and second pressure values).

By way of example, the failure detection apparatus may, with the monitoring and failure detection unit, determine the first predetermined tolerance range of relative pressure values (e.g., predetermined tolerance range of relative pressure values 310 of FIGS. 2 to 3C) and the second predetermined tolerance range of relative pressure values (e.g., predetermined tolerance range of relative pressure values 320 of FIGS. 2 to 3C) based on the faultless operation curve.

Illustratively, the failure detection apparatus may, with the monitoring and failure detection unit, determine a trend (e.g., trend 350 and/or trend 360 of FIGS. 2 to 3C) based on the plurality of 2-tuples (e.g., 2-tuples 341, 342, 343, 344, 345 of FIGS. 2 to 3C), and detect at least one of the failure of at least one hydraulically operated device of the plurality of hydraulically operated devices or the failure of the pump based on the trend.

By way of example, the failure detection apparatus may, generate and provide statistics about the first and second pressure values of the hydraulic fluid based on the plurality of 2-tuples (e.g., 2-tuples 341, 342, 343, 344, 345 of FIGS. 2 to 3C) at the different time stamps.

Illustratively, the failure detection apparatus may, in response to detecting a failure of the at least one hydraulically operated device of the plurality of hydraulically operated devices or in response to detecting a failure of the pump, notify an operator of the hydraulic system about the detected failure.

It should be noted that modifications to the above described embodiments are within the common knowledge of the person skilled in the art and, thus, also considered as being part of the present disclosure.

For example, the predetermined tolerance range of relative pressure values 310 of FIGS. 2 to 3C is shown as having a constant distance from the faultless operation curve 390. However, the predetermined tolerance range of relative pressure values 310 may have a distance from the faultless operation curve 390 that increases with an increase in supply pressure and/or case pressure, if desired.

Similarly, the predetermined tolerance range of relative pressure values 320 of FIGS. 2 to 3C is shown as having a constant width independent of the case pressure 301. However, the predetermined tolerance range of relative pressure values 320 may increase in width with an increase in case pressure, if desired.

Furthermore, the two-dimensional Cartesian coordinate system 300 of FIGS. 2 to 3C show case pressure 301 as ordinate and supply pressure 302 as abscissa. However, the two-dimensional Cartesian coordinate system 300 of FIGS. 2 to 3C may have the supply pressure 302 as ordinate and the case pressure 301 as abscissa, if desired.

REFERENCE LIST

10 hydraulic, failure detection-capable system
100 hydraulic system
110 tank
120 hydraulic fluid
130 hydraulically operated devices
140 supply line
150 case drain line
160 pump
170 return line
180 filter
190 drive mechanism
200 failure detection apparatus
210, 220 pressure sensor
230 temperature sensor
240 monitoring and failure detection unit
250 monitoring unit
260 failure detection unit
270 calibration unit
280 output device
300 two-dimensional Cartesian coordinate system
301 case pressure
302 supply pressure
310, 320 predetermined tolerance range of relative pressure values
330, 331, 332, 333, 334, 335 calibration point
341 2-tuple of supply and case pressure at a first time stamp
342 2-tuple of supply and case pressure at a second time stamp
343 2-tuple of supply and case pressure at a third time stamp
344 2-tuple of supply and case pressure at a fourth time stamp
345 2-tuple of supply and case pressure at time stamp n
350 trend monitoring indicative of pump failure
360 trend monitoring indicative of hydraulically operated device failure
390 faultless operation curve
400 method
410, 420, 430, 440, 450, 460, 470 operations

What is claimed is:

1. A failure detection apparatus for a hydraulic system, the hydraulic system comprising a tank with hydraulic fluid, a plurality of hydraulically operated devices, a supply line, a pump that delivers the hydraulic fluid from the tank via the supply line to the plurality of hydraulically operated devices, and a case drain line for returning hydraulic fluid from the pump to the tank, wherein the failure detection apparatus comprises:

a first pressure sensor that senses a first pressure value of the hydraulic fluid in the supply line;

a second pressure sensor that senses a second pressure value of the hydraulic fluid in the case drain line; and a monitoring and failure detection unit that receives the first and second pressure values from the first and second pressure sensors and comprises:

a monitoring unit that monitors a plurality of the first and second pressure values from the first and second pressure sensors during operation of the plurality of hydraulically operated devices, a failure detection unit that memorizes a plurality of 2-tuples of first and second pressure values, wherein the failure detection unit detects a failure of at least one hydraulically operated device of the plurality of hydraulically operated devices when a 2-tuple of the plurality of 2-tuples is within a first predetermined tolerance range of relative pressure values and outside a second predetermined tolerance range of relative pressure values, and wherein the failure detection unit detects a failure of the pump when the 2-tuple of the plurality of 2-tuples is outside the first predetermined tolerance range of relative pressure values, and an output device that, in response to the failure detection unit detecting the failure of at least one hydraulically operated device of the plurality of hydraulically operated devices or the failure of the pump, notifies an operator of the hydraulic system about the detected failure.

2. The failure detection apparatus of claim 1, wherein the failure detection unit determines a trend based on the plurality of 2-tuples, and wherein the failure detection unit detects at least one of the failure of at least one hydraulically operated device of the plurality of hydraulically operated devices or the failure of the pump based on the trend.

3. The failure detection apparatus of claim 1, further comprising:

a temperature sensor that senses a current temperature value of the hydraulic fluid in the tank and provides the current temperature value to the monitoring and failure detection unit, and wherein the failure detection unit adjusts the first predetermined tolerance range of relative pressure values and the second predetermined tolerance range of relative pressure values based on the current temperature value of the hydraulic fluid.

4. The failure detection apparatus of claim 1, wherein the monitoring and failure detection unit further comprises:

a calibration unit that determines the first predetermined tolerance range of relative pressure values and the second predetermined tolerance range of relative pressure values based on the first and second pressure values received from the first and second pressure sensors during an initial calibration of the hydraulic system before the operation of the plurality of hydraulically operated devices.

5. The failure detection apparatus of claim 4, wherein the calibration unit determines the first and the second predetermined tolerance ranges of relative pressure values based on predetermined operation conditions of the pump.

6. A hydraulic, failure detection-capable system comprising:

a hydraulic system that includes:

a tank with hydraulic fluid, a plurality of hydraulically operated devices, a supply line, a pump that delivers the hydraulic fluid from the tank via the supply line to the plurality of hydraulically operated devices, a return line for returning the hydraulic fluid from the plurality of hydraulically operated devices to the tank, and a case drain line for returning hydraulic fluid from the pump to the tank; and a failure detection apparatus for the hydraulic system, the failure detection apparatus includes:

a first pressure sensor that senses a first pressure value of the hydraulic fluid in the supply line, a second pressure sensor that senses a second pressure value of the hydraulic fluid in the case drain line, and a monitoring and failure detection unit that receives the first and second pressure values from the first and second pressure sensors, the monitoring and failure detection unit includes:

a monitoring unit that monitors a plurality of the first and second pressure values from the first and second pressure sensors during operation of the plurality of hydraulically operated devices, a failure detection unit that memorizes a plurality of 2-tuples of first and second pressure values, wherein the failure detection unit detects a failure of at least one hydraulically operated device of the plurality of hydraulically operated devices when a 2-tuple of the plurality of 2-tuples is within a first predetermined tolerance range of relative pressure values and outside a second predetermined tolerance range of relative pressure values, and wherein the failure detection unit detects a failure of the pump when the 2-tuple of the plurality of 2-tuples is outside the first predetermined tolerance range of relative pressure values, and an output device that, in response to the failure detection unit detecting the failure of at least one hydraulically operated device of the plurality of hydraulically operated devices or the failure of the pump, notifies an operator of the hydraulic system about the detected failure.

7. The hydraulic, failure detection-capable system of claim 6, wherein the hydraulic system further comprises:

a filter in the supply line between the pump and the plurality of hydraulically operated devices.

8. The hydraulic, failure detection-capable system of claim 6, wherein the hydraulic system further comprises:

a drive mechanism that drives the pump.

9. A failure detection method for a hydraulic system, the hydraulic system comprising a tank with hydraulic fluid, a plurality of hydraulically operated devices, a supply line, a pump that delivers the hydraulic fluid from the tank via the supply line to the plurality of hydraulically operated devices, and a case drain line for returning hydraulic fluid from the pump to the tank, the method comprising:

with a first pressure sensor, sensing a first pressure value of the hydraulic fluid in the supply line;

with a second pressure sensor, sensing a second pressure value of the hydraulic fluid in the case drain line;

with a monitoring and failure detection unit, receiving the first and second pressure values from the first and second pressure sensors;

with a monitoring unit of the monitoring and failure detection unit, monitoring a plurality of the first and second pressure values from the first and second pressure sensors when the hydraulic system is in a normal operation mode;

with a failure detection unit of the monitoring and failure detection unit, memorizing a plurality of 2-tuples of first and second pressure values in the normal operation mode;

with the failure detection unit of the monitoring and failure detection unit, detecting a failure of at least one hydraulically operated device of the plurality of hydraulically operated devices when a 2-tuple of the plurality of 2-tuples is within a first predetermined tolerance range of relative pressure values and outside a second predetermined tolerance range of relative pressure values;

with the failure detection unit of the monitoring and failure detection unit, detecting a failure of the pump when the 2-tuple of the plurality of 2-tuples is outside the first predetermined tolerance range of relative pressure values; and with an output device of the monitoring and failure detection unit, in response to the failure of at least one hydraulically operated device of the plurality of hydraulically operated devices or the failure of the pump being detected, notifying an operator of the hydraulic system about the detected failure.

10. The method of claim 9, further comprising:

with the monitoring and failure detection unit, generating a faultless operation curve based on an extrapolation of the first and second pressure values that are received by the monitoring and failure detection unit when the hydraulic system is in a calibration mode.

11. The method of claim 10, further comprising:

with the monitoring and failure detection unit, determining the first predetermined tolerance range of relative pressure values and the second predetermined tolerance range of relative pressure values based on the faultless operation curve.

12. The method of claim 9, further comprising:

with the monitoring and failure detection unit, determining a trend based on the plurality of 2-tuples; and detecting at least one of the failure of at least one hydraulically operated device of the plurality of hydraulically operated devices or the failure of the pump based on the trend.

13. The method of claim 12, further comprising:

generating and providing statistics about the first and second pressure values of the hydraulic fluid based on the plurality of 2-tuples at the different time stamps.

* * * * *